US007198032B2

(12) United States Patent
Taguchi et al.

(10) Patent No.: US 7,198,032 B2
(45) **Date of Patent: *Apr. 3, 2007**

(54) STRUCTURE OF FUEL SUPPLY PIPE IN THROTTLE BODY COMPRISING TWO FUEL INJECTION VALVES

(75) Inventors: Naohiro Taguchi, Kawasaki (JP); Shunsuke Mochizuki, Kawasaki (JP)

(73) Assignee: Keihin Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/377,321

(22) Filed: Mar. 17, 2006

(65) Prior Publication Data

US 2006/0225708 A1 Oct. 12, 2006

(30) Foreign Application Priority Data

Mar. 17, 2006 (JP) ..... 2005-077006

(51) Int. Cl.
*F02M 31/04* (2006.01)

(52) U.S. Cl. ..... 123/470; 123/456

(58) Field of Classification Search ..... 123/470, 123/472, 468, 469, 456, 337, 336
See application file for complete search history.

(56) References Cited

U.S. PATENT DOCUMENTS 3,868,936 A * 3/1975 Rivere ..... 123/445
4,132,204 A * 1/1979 Teague ..... 123/456
4,235,205 A * 11/1980 Fukui et al. ..... 123/472
4,323,041 A * 4/1982 Endo et al. ..... 123/432
4,516,555 A * 5/1985 Shioya et al. ..... 123/470
6,039,029 A * 3/2000 Nagasaka et al. ..... 123/442
6,732,711 B2 * 5/2004 Yanagii ..... 123/469
6,971,371 B2 * 12/2005 Hotta et al. ..... 123/470
7,028,665 B2 * 4/2006 Taguchi ..... 123/336
2005/0188959 A1 * 9/2005 Udono ..... 123/470
2005/0229902 A1 * 10/2005 Taguchi ..... 123/336
2006/0157021 A1 * 7/2006 Nakagawa ..... 123/336

* cited by examiner

*Primary Examiner*—Carl S. Miller
(74) *Attorney, Agent, or Firm*—Bacon & Thomas, PLLC

(57) ABSTRACT

An improved fuel supply pipe in a multiple throttle body comprising two fuel injection valves comprises a first fuel supply pipe 1 having a first one side inserting pipe 1*c*, a first another side inserting pipe 1*d* and a fuel flow-in pipe 1*b*, a second fuel supply pipe 2 having a second one side inserting pipe 2*b* and a second another side inserting pipe 2*c* and a fuel connection pipe 3 for connecting these pipes 1 and 2, a first one side inserting pipe 1*c* is inserted into one side first inserting hole 10*c*, a second one side inserting pipe 2*d* is inserted into one side second inserting hole 11*c*, a first another side inserting pipe 1*d* is inserted into another side first inserting hole 12*c*, and a second another side inserting pipe 2*c* is inserted into another side second inserting hole 13*c*.

1 Claim, 5 Drawing Sheets

STRUCTURE OF FUEL SUPPLY PIPE IN THROTTLE BODY COMPRISING TWO FUEL INJECTION VALVES

BACKGROUND OF THE INVENTION

1. Field of the Invention

The present invention relates to a fuel injection device for injecting and supplying fuel toward an internal combustion engine from a fuel injection valve mounted at a throttle body, and more particularly, a structure of a fuel supply pipe in a multiple throttle body, in which a first fuel injection valve and a second injection valve are mounted at a single throttle body, and a plurality of such the throttle bodies arranged sideward.

2. Description of the Conventional Art

A conventional structure of a fuel supply pipe in a multiple throttle body comprising two injection valves is indicated in FIG. 6.

Reference numeral 30 is a throttle body in which an intake passage 31 is provided through and bored inside thereof. The intake passage 31 is opened and closed by a throttle valve 33 mounted at a throttle valve shaft 32, which crosses the intake passage 31 and is rotatably supported.

A first injection valve J1 and a second injection valve J2 are mounted at the throttle body 30. The first injection valve J1 is for injecting and supplying the fuel toward an intake passage 31*a* on the downstream side from the throttle valve 33, and the second injection valve J2 is for injecting and supplying the fuel toward an intake passage 31*b* on the upstream side from the throttle valve 33. Such the first fuel injection valve J1 shares a fuel supply area at the time of a low opening operation and an intermediate opening operation of the internal combustion engine. Such the second fuel injection valve J2 shares a fuel supply area at the time of a high opening operation of the internal combustion engine.

Further, when the multiple throttle body is formed, a plurality of single throttle bodies 30 comprising the two fuel injection valves J1, J2 are arranged sideward. At this time, each throttle body 30 is fixed by a mounting stay or the like with a desired mounting pitch, and the throttle valve shaft 32 in each throttle body 30 is linked to be simultaneously rotated.

As for the multiple throttle body illustrated in FIG. 6, four single throttle bodies 30 are fixed sideward.

Further, a first fuel distribution pipe 34 supporting a rear end portion of the first fuel injection valve J1 comprises four injection valve inserting holes (those are not illustrated in the drawings), a first fuel distribution passage 35 and a first fuel flow-in pipe 36. The four injection valve inserting holes are inserted with the rear end portions of respective first fuel injection valves J1, and are opened downwardly. The first fuel distribution passage 35 is for distributing and supplying the fuel toward each injection valve inserting hole, and is extended in the side direction. The first fuel flow-in pipe 36 is for introducing the fuel toward the first fuel distribution passage 35 from the outside.

Therefore, the first fuel distribution pipe 34 is fixedly provided sideward along the multiple throttle body, and the rear end portion of each first fuel injection valve J1 is inserted into each injection valve inserting hole, so that each first fuel injection valve J1 can be held by each throttle valve 30 and the first fuel distribution pipe 34.

On the other hand, a second fuel distribution pipe 37 supporting a rear end portion of the second fuel injection valve J2 comprises four injection valve inserting holes (those are not illustrated in the drawings), a second fuel distribution passage 38 and a second fuel flow-in pipe 39. The four injection valve inserting holes are inserted with the rear end portions of respective second fuel injection valves J2, and are opened downwardly. The second fuel distribution passage 38 is for distributing and supplying the fuel toward each injection valve inserting hole, and is extended in the side direction. The first fuel flow-in pipe 39 is for introducing the fuel toward the second fuel distribution passage 38 from the outside.

Therefore, the second fuel distribution pipe 37 is fixedly provided sideward along the multiple throttle body, and the rear end portion of each second fuel injection valve J2 is inserted into each injection valve inserting hole, so that each second fuel injection valve J2 can be held by each throttle valve 30 and the second fuel distribution pipe 37.

SUMMARY OF THE INVENTION

According to such the conventional multiple throttle body comprising two fuel injection valves, the first fuel flow-in pipe 36 of the first fuel distribution pipe 34 is connected to a pump discharge passage of a fuel pump, which is not illustrated in the drawings, by a first fuel pipe 40*a*.

Further, the second fuel flow-in pipe 39 of the second fuel distribution pipe 37 is connected to the pump discharge passage of the fuel pump by a second fuel pipe 40*b*.

Thereby, a part of the fuel increased in pressure by the fuel pump is supplied to the first fuel distribution passage 35 of the first fuel distribution pipe 34 through the first fuel pipe 40*a*, and the fuel in the first fuel distribution passage 35 is supplied to each first fuel injection valve J1.

On the other hand, another part of the fuel increased in pressure by the fuel pump is supplied to the second fuel distribution passage 38 of the second fuel distribution pipe 37 through the second fuel pipe 40*b*, and the fuel in the second fuel distribution passage 38 is supplied to each second fuel injection valve J2.

As described above, according to the conventional structure of the fuel supply pipe in the multiple throttle body, two long first fuel pipe 40*a* and second fuel pipe 40*b* are necessary between the multiple throttle body and the fuel pump.

The reasons why such the first and second fuel pipes 40*a*, 40*b* become long are that the fuel pump is provided in a fuel tank or near the fuel tank which is positioned far from an internal combustion engine and the multiple throttle body is provided near the internal combustion engine.

As described above, in a motorcycle or the like in which the internal combustion engine, the multiple throttle body and the fuel tank are directly exposed to the atmosphere, the two fuel pipes 40*a*, 40*b* are also directly exposed to the atmosphere. Thus, appearance is poor, and designing freedom of the two long fuel pipes are limited in the motorcycle or the like not having enough housing space.

The structure of the fuel supply pipe in the multiple throttle body comprising two fuel injection valves of the present invention solves the above-described problems, and an objective of the present invention is to provide the structure of the fuel supply pipe, in which the number of the long fuel pipes for connecting the fuel pump and the fuel distribution pipes is reduced to one, so that the appearance of the motorcycle, designing freedom of the fuel pipe, and mountability to the motorcycle can be improved.

A structure of a fuel supply pipe in a multiple throttle body comprising two fuel injection valves according to one aspect of the present invention is structured as follows in order to obtain the above-described objective. The multiple throttle body has a plurality of throttle bodies arranged sideward, where each of the throttle bodies has a first fuel injection valve and a second fuel injection valve, the first fuel injection valve is provided toward an intake passage on the downstream side of a throttle valve for opening/closing the intake passage, and the second fuel injection valve is provided toward an intake passage on the upstream side of the throttle valve. In such the multiple throttle body, the fuel supply pipe is formed with a first fuel supply pipe, a second fuel supply pipe and a fuel connection pipe. The first fuel supply pipe comprises a first one side inserting pipe, a first another side inserting pipe, and a fuel flow-in pipe. The first one side inserting pipe is projected toward one side direction X from a first cylindrical portion, the first another side inserting pipe is projected toward another side direction Y from the first cylindrical portion and is formed coaxially with the first one side inserting pipe, and a fuel flow-in pipe is projected toward another direction from the first cylindrical portion. In the first fuel supply pipe, a fuel flow-in passage is provided toward an end portion of the fuel flow-in pipe from an end portion of the first cylindrical portion, and the fuel flow-in passage is provided with a first one side fuel supply passage and a first another side fuel supply passage, where the first fuel supply passage is provided toward an end portion of the first one side inserting pipe, and the first another side fuel supply passage is provided toward an end portion of the first another side inserting pipe. The second fuel supply pipe comprises a second one side inserting pipe, and a second another side inserting pipe. The second one side inserting pipe is projected toward the one side direction X in parallel to the first one side inserting pipe from a second cylindrical portion. The second another side inserting pipe is projected toward the another side direction Y from the second cylindrical portion and is formed coaxially with the second one side inserting pipe. In the second fuel supply pipe, a second one side fuel supply passage is provided toward an end portion of the second one side inserting pipe from an end portion of the second cylindrical portion, and a second another side fuel supply passage is provided toward an end portion of the second another side inserting pipe from the second one side fuel supply passage. The fuel connection pipe is for connecting the fuel flow-in passage and the second one side fuel supply passage, where the fuel flow-in passage is opened on the end portion of the first cylindrical portion of the first fuel supply pipe, and the second one side fuel supply passage is opened on the end portion of the second cylindrical portion of the second fuel supply pipe. On the other hand, a one side first inserting boss is projected and formed toward the another side direction Y at a one side first fuel distribution pipe, which is for holding the first fuel injection valve with a throttle body on the one side, the throttle bodies being provided side by side. A one side first inserting hole is provided at the one side first inserting boss, where one end of the one side first inserting hole is connected to a first fuel injection valve inserting hole, and another end is opened in the another side direction Y toward an end portion of the one side first inserting boss. A one side second inserting boss is formed at a one side second fuel distribution pipe, which is for holding the second fuel injection valve with the one side throttle body, where the one side second inserting boss is projected in the another side direction Y and formed in parallel to the one side first inserting boss. A one side second inserting hole is provided at the one side second inserting boss, where one end of this one side second inserting hole is connected to a second fuel injection valve inserting hole, and another end is opened in the another side direction Y toward an end portion of the one side second inserting boss. Further, an another side first inserting boss is projected and formed toward the one side direction X at an another side first fuel distribution pipe, which is for holding the first fuel injection valve with the throttle body on the another side, the throttle bodies being provided side by side. An another side first inserting hole is provided at the another side first inserting boss, where one end of the another side first inserting hole is connected to the first fuel injection valve inserting hole, and another end is opened in the one side direction X toward an end portion of the another side first inserting boss. An another side second inserting boss is formed at an another side second fuel distribution pipe, which is for holding a second fuel injection valve with the another side throttle body, where the another side second inserting boss is projected toward the one side direction X and formed in parallel to the another side first inserting boss. An another side second inserting hole is provided at the another side second inserting boss, where one end of the another side second inserting hole is connected to a second fuel injection valve inserting hole, and another end is opened in the one side direction X toward an end portion of the another side second inserting boss. Further, the fuel supply pipe is provided between the another side wall side of the one side throttle body and the one side wall side of the another side throttle body. Furthermore, the first one side inserting pipe is inserted into the one side first inserting hole, the second one side inserting pipe is inserted into the one side second inserting hole, the first another side inserting pipe is inserted into the another side first inserting hole, and the second another side inserting pipe is inserted into the another side second inserting hole, whereby each inserting pipe of the fuel supply pipe is held in each inserting hole of each fuel distribution pipe.

According to the present invention, a plurality of throttle bodies comprising two fuel injection valves is arranged in the side direction, the first fuel injection valve provided at the throttle body, on the one side is held by the one side first fuel distribution pipe, where the throttle bodies are provided side by side, the second fuel injection valve is held by the one side second fuel distribution pipe, the one side first inserting hole is opened toward the another side direction from the one side first fuel distribution pipe, and the one side second inserting hole is opened toward the another side direction from the one side second fuel distribution pipe.

On the other hand, the first fuel injection valve provided at the throttle body on the another side is held by the another side first fuel distribution pipe, where the throttle bodies are provided side by side, the second fuel injection valve is held by the second fuel distribution pipe, the another side first inserting hole is opened toward the one side direction from the another side first fuel distribution pipe, and the another side second inserting hole is opened toward the one side direction from the another side second fuel distribution pipe.

Further, the one side first inserting hole and the another side first inserting hole are opened and provided so as to oppose each other, and provided in the coaxial state. The one side second inserting hole and the another side second inserting hole are opened and provided so as to oppose each other, and provided in the coaxial state.

Further, the fuel supply pipe is provided between the another side wall of the throttle body on the one side and the one side wall of the throttle body on the another side, the throttle bodies being provided side by side. At this time, the first one side inserting pipe is inserted into the one side first inserting hole, the second one side inserting pipe is inserted into the one side second inserting hole, the first another side inserting pipe is inserted into the another side first inserting hole, and the second another side inserting pipe is inserted into the another side second inserting hole.

Further, the fuel flow-in pipe of the fuel supply pipe and the pump discharge passage of the fuel pump are connected by the fuel pipe.

As described above, the fuel increased in pressure by the fuel pump is supplied to the fuel flow-in passage of the fuel supply pipe through the pump discharge passage and the fuel pipe. Then, the fuel is supplied to the first fuel injection valve of the throttle body on the one side through the first one side fuel supply passage and the one side first inserting hole, and supplied to the first fuel injection valve of the throttle body on the another side through the first another side fuel supply passage and the another side first inserting hole.

On the other hand, the fuel flowing in the fuel flow-in passage is supplied to the second one side fuel supply passage through the fuel connection pipe. The fuel in the second one side fuel supply passage is supplied to the second fuel injection valve of the throttle body on the one side through the one side second inserting hole. Furthermore, the fuel in the second one side fuel supply passage is supplied to the second fuel injection valve of the throttle body on the another side through the second another side fuel supply passage and the another side second inserting hole.

When such the structure of the fuel supply pipe is used, the fuel supply pipe provided at the throttle body is connected to the pump discharge passage of the fuel pump with the single fuel pipe, so that appearance of the motorcycle can be improved when it is mounted to the motorcycle or the like, and designing freedom of piping of the fuel pipe can be improved.

Further, since the fuel supply pipe is provided between the another side wall and the one side wall of the throttle bodies provided side by side, the side length of the multiple throttle body is not increased, so that it is effective in the motorcycle in which the side length is limited.

Further, the fuel supply pipe is held by the one side first inserting hole and the another side first inserting hole, which oppose each other, and held by the one side second inserting hole and the another side second inserting hole, so that a mounting member, a screw or the like, which is for fixing the fuel supply pipe at the throttle body, is not necessary.

Furthermore, the fuel supply pipe is provided between the walls of the throttle bodies, which are provided side by side, so that the fuel supply pipe is not directly exposed to the outside when it is mounted on the motorcycle, to thereby improve appearance of the motorcycle.

DETAILED DESCRIPTION OF PREFERRED EMBODIMENT

Hereinafter, one example of the structure of the fuel supply pipe in the multiple throttle body comprising two fuel injection valves according to the present invention will be described with drawings.

A fuel supply pipe F will be described with FIGS. 1 and 2.

Figure 1:
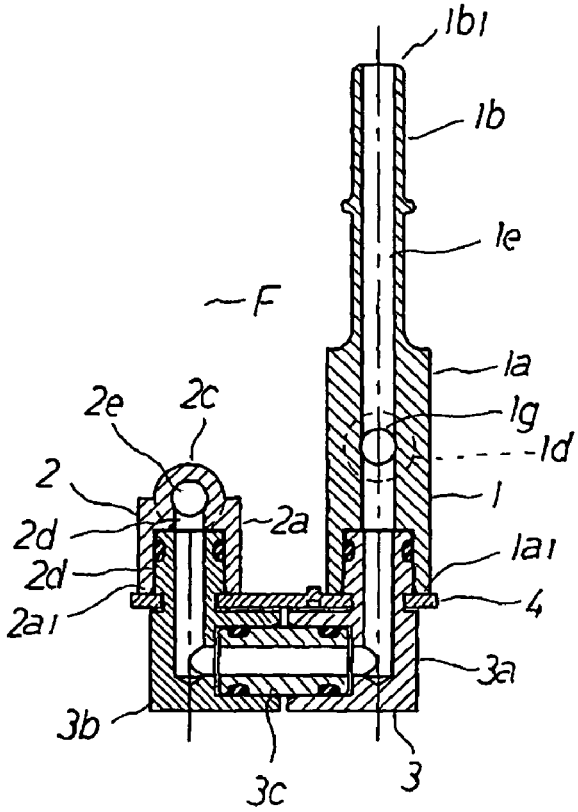
FIG. 1 is a longitudinal sectional view illustrating one example of a fuel supply pipe used in a multiple throttle body comprising two fuel injection valves according to the present invention.

FIG. 1 is a longitudinal sectional view of a fuel supply pipe.

Figure 2:
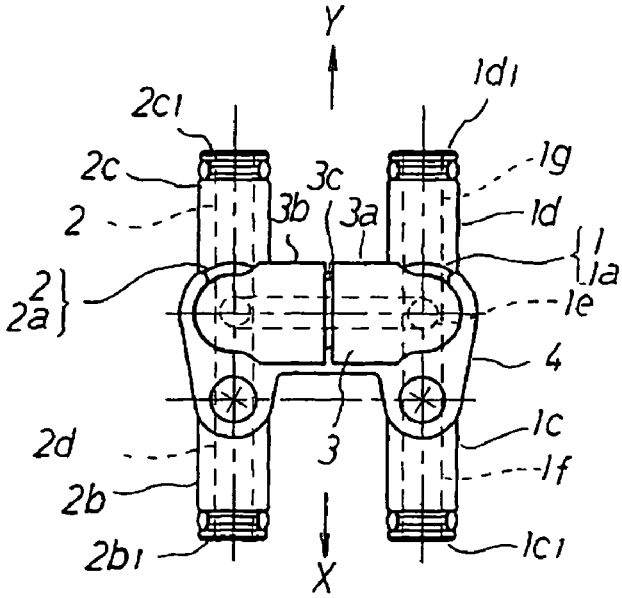
FIG. 2 is a plan view seen from the bottom of FIG. 1.

FIG. 2 is horizontal plan view seen from the bottom of FIG. 1.

Reference code 1*a* is a first cylindrical portion extending upwardly and downwardly in FIG. 1, and a fuel flow-in pipe 1*b* is projected toward the upper direction further from the first cylindrical portion 1*a*.

A first one side inserting pipe 1*c* is formed to project toward one side direction X at an outer circumference portion of the first cylindrical portion, and a first another side inserting pipe 1*d* is formed to project toward another side direction Y.

The first one side inserting pipe and the first another side inserting pipe 1*d* are formed coaxially.

Further, a fuel flow-in passage 1*e* is provided toward an end portion 1*b*1 (it is an upper end) of the fuel flow-in passage 1*b* from an end portion 1*a*1 (it is a lower end) of the first cylindrical portion 1*a*. Further, a first one side fuel supply passage 1*f* is provided toward an end portion 1*c*1 of the first one side inserting pipe 1*c*, and a first another side fuel supply passage 1*g* is provided toward an end portion 1*d*1 of the first another side inserting pipe 1*d*.

A first fuel supply pipe 1 is formed having the above-described constitution.

Reference code 2*a* is a second cylindrical portion extending upwardly and downwardly in FIG. 1. Further, a second inserting pipe 2*b* is formed to project toward the one side direction X from the second cylindrical portion 2*a*, and a second another side inserting pipe 2*c* is formed to project toward the another side direction Y.

The second inserting pipe 2*b* and the second another side inserting pipe 2*c* are formed coaxially.

Further, a second one side fuel supply passage 2*d* is provided from an end portion 2*a*1 (it is a lower end) of the second cylindrical portion 2*a* toward an end portion 2*b*1 of the second one side inserting pipe 2*b*. Further, a second another side fuel supply passage 2*e* is provided from the second one side fuel supply passage 2*d* toward an end portion 2*c*1 of the second another side inserting pipe 2*c*.

A second fuel supply pipe 2 is formed having the above-described constitution, and the first one side inserting pipe 1*c* and the first another side inserting pipe 1*d* of the first fuel supply pipe is formed in parallel to the second one side inserting pipe 2*b* and the second another side inserting pipe 2*c* of the second fuel supply pipe 2.

Then, passages of the first fuel supply pipe and the second fuel supply pipe 2 are connected with a fuel connecting pipe 3.

In this embodiment, the fuel connecting pipe 3 comprises a L shaped first connection pipe 3*a* which is bent in the left direction, a L shaped-second connection pipe 3*b* which is bent in the right direction, and a connection pipe 3*c* for connecting opposite portions of the first connection pipe 3*a* and the second connection pipe 3*b*.

Further, an upper portion of the first connection pipe 3*a* is inserted into the fuel flow-in passage 1*e* which is opened and expanded at the end portion 1*a*1 of the first cylindrical portion 1*a* of the first fuel supply pipe 1. An upper portion of the second connection pipe 3*b* is inserted into the second one side fuel supply passage 2*d* which is opened at the end portion 2*a*1 of the second cylindrical portion 2*a*. In these inserting states, the first connection pipe 3*a* is screwed into the end portion 1*a*1 of the first cylindrical portion 1*a* and the second connecting pipe 3*b* is screwed into the end portion 2*a*1 of the second cylindrical portion 2*a*, through a mounting plate 4.

In this way, the fuel supply pipe F comprising the first fuel supply pipe 1, the second fuel supply pipe 2, and the fuel connection pipe 3 is formed. In this fuel supply pipe F, as described above, the first one side inserting pipe 1*c* and the first another side inserting pipe 1*d* are formed coaxially, the second one side inserting pipe 2*c* and the second another side inserting pipe 2*c* are formed coaxially, and the first one side inserting pipe 1*c* and the first another side inserting pipe 1*d* are provided in parallel to the second one side inserting pipe 2*b* and the second another side inserting pipe 2*c*.

Figure 6:
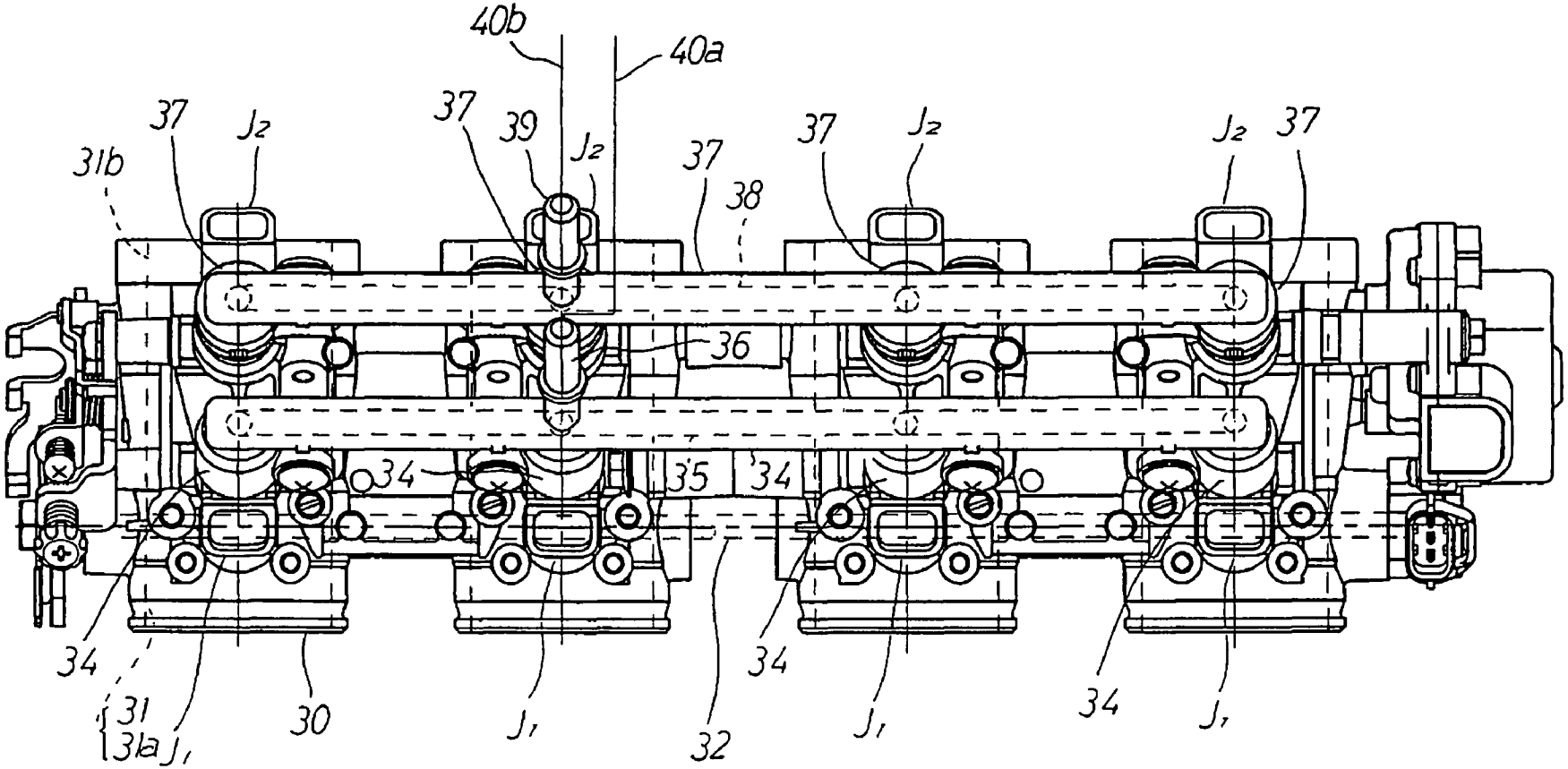
FIG. 6 is an upper part plan view illustrating a conventional fuel supply pipe in a multiple throttle body comprising two fuel injection valves.

Then, four throttle bodies each of which comprises two fuel injection valves are provided sideward like FIG. 6.

Same reference numerals and codes of the throttle body 30, and first and second fuel injection valves J1, J2 as those of FIG. 6 are used, and descriptions are omitted.

Four throttle bodies 30 each of which comprises the first fuel injection valve J1 and the second fuel injection valve J2 are provided sideward. First fuel injection valves J1, J1 are provided at two throttle bodies 30*a*, 30*b* on the left side in FIG. 3, and are held by first fuel injection valve inserting holes 10*a*, 10*a* and first inserting holes 30*e* (illustrated in FIG. 4), where the holes 10*a*, 10*a* are provided through at an one side first fuel distribution pipe 10 extended toward the side direction, and the holes 30*e* are provided at the throttle bodies 30*a*, 30*b*.

Figure 3:
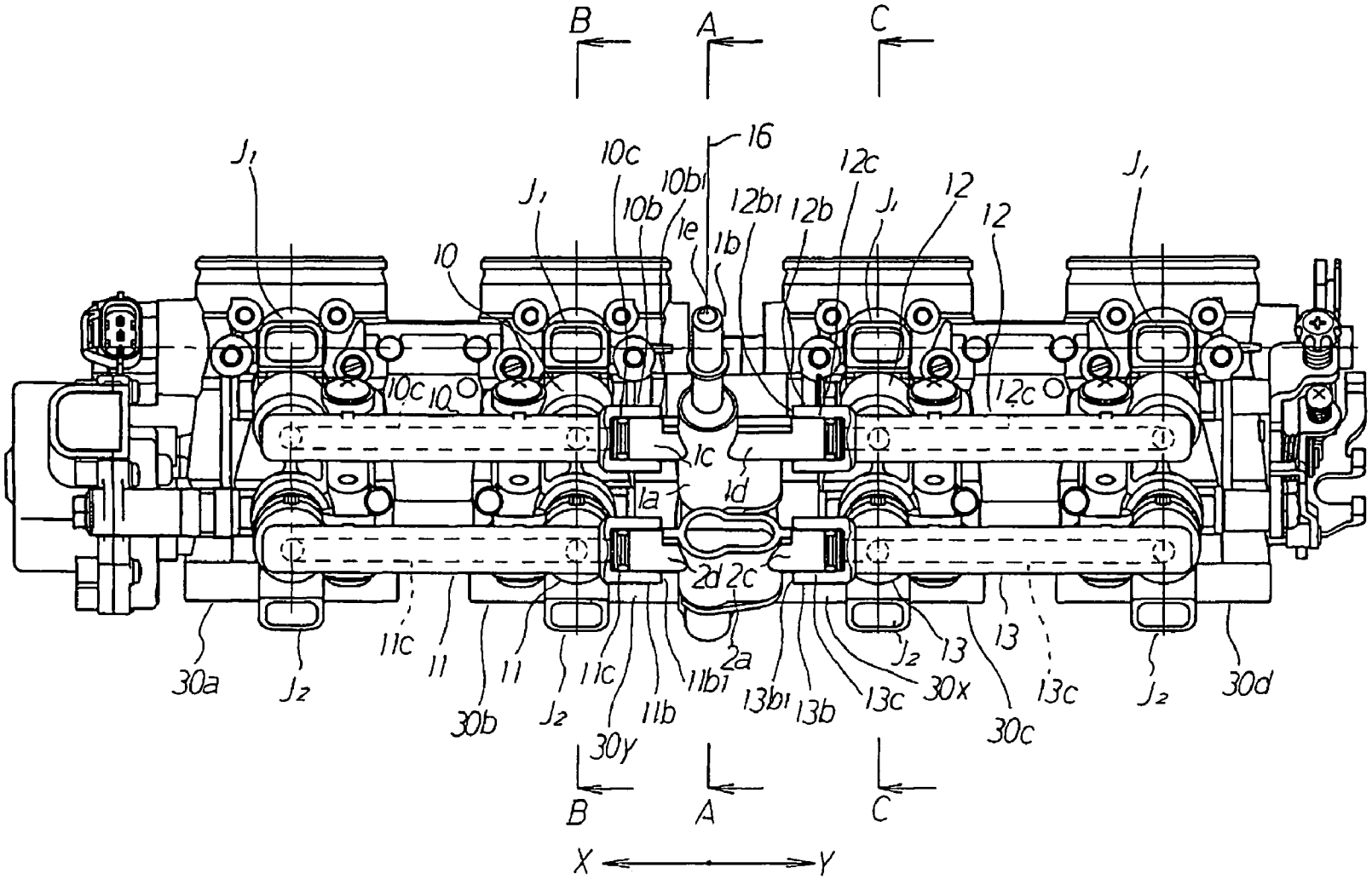
FIG. 3 is an upper part plan view illustrating one example of a fuel supply pipe in a multiple throttle body comprising two fuel injection valves according to the present invention.
Figure 4:
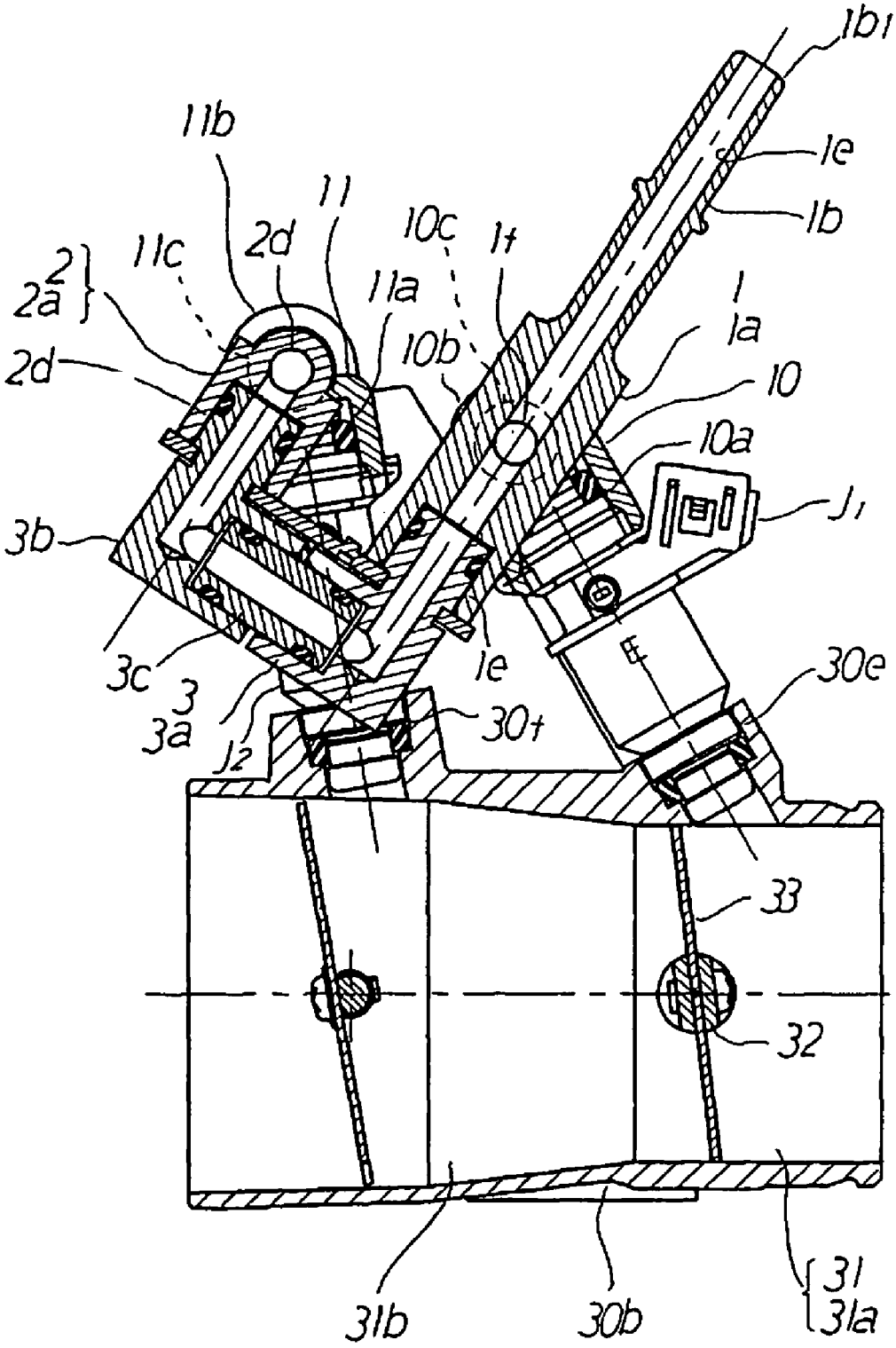
FIG. 4 is a compound longitudinal sectional view simultaneously illustrating cross sections taken along the A—A line and the B—B line of FIG. 3.

Further, a one side first inserting boss 10*b* is formed at a right end of the one side first fuel distribution pipe 10, and projected toward the another side direction Y (the right direction in FIG. 3). Further, a one side first inserting hole 10*c* is provided from an end portion 10*b*1 (a right end in FIG. 3) of the one side first inserting boss 10*b* toward each first fuel injection valve inserting hole 10*a*.

That is, the one side first inserting hole 10*c* is connected to each first fuel injection valve inserting hole 10*a*.

Further, second fuel injection valves J2, J2 are provided at two throttle bodies 30*a*, 30*b* on the left side, and held by second fuel injection valve inserting holes 11*a* and second inserting holes 30*f* (illustrated in FIG. 4), where the holes 11*a* are provided through at a one side second fuel distribution pipe 11 extended toward the side direction, and the holes 30*f* are provided at the throttle bodies 30*a*, 30*b*.

Further, a one side second inserting boss 11*b* is formed at a right end of the one side second fuel distribution pipe 11, and projected toward the another side direction Y (the right direction in FIG. 3). Further, an one side second inserting hole 11*c* is provided from an end portion 11*b*1 of the one side second inserting boss 11*b* toward each second fuel injection valve inserting hole 11*a*.

That is, the one side second inserting hole 11*c* is connected to each second fuel injection valve inserting hole 11*a*.

Further, the one side first inserting boss 10*b* provided with the one side first inserting hole 10*c* is formed in parallel to the one side second inserting boss 11*b* provided with one side second inserting hole 11*c*. Openings of the one side first inserting hole 10*c* and the one side second inserting hole 11*c* are in parallel each other and opened toward the another side direction (the right side direction in FIG. 3).

Figure 5:
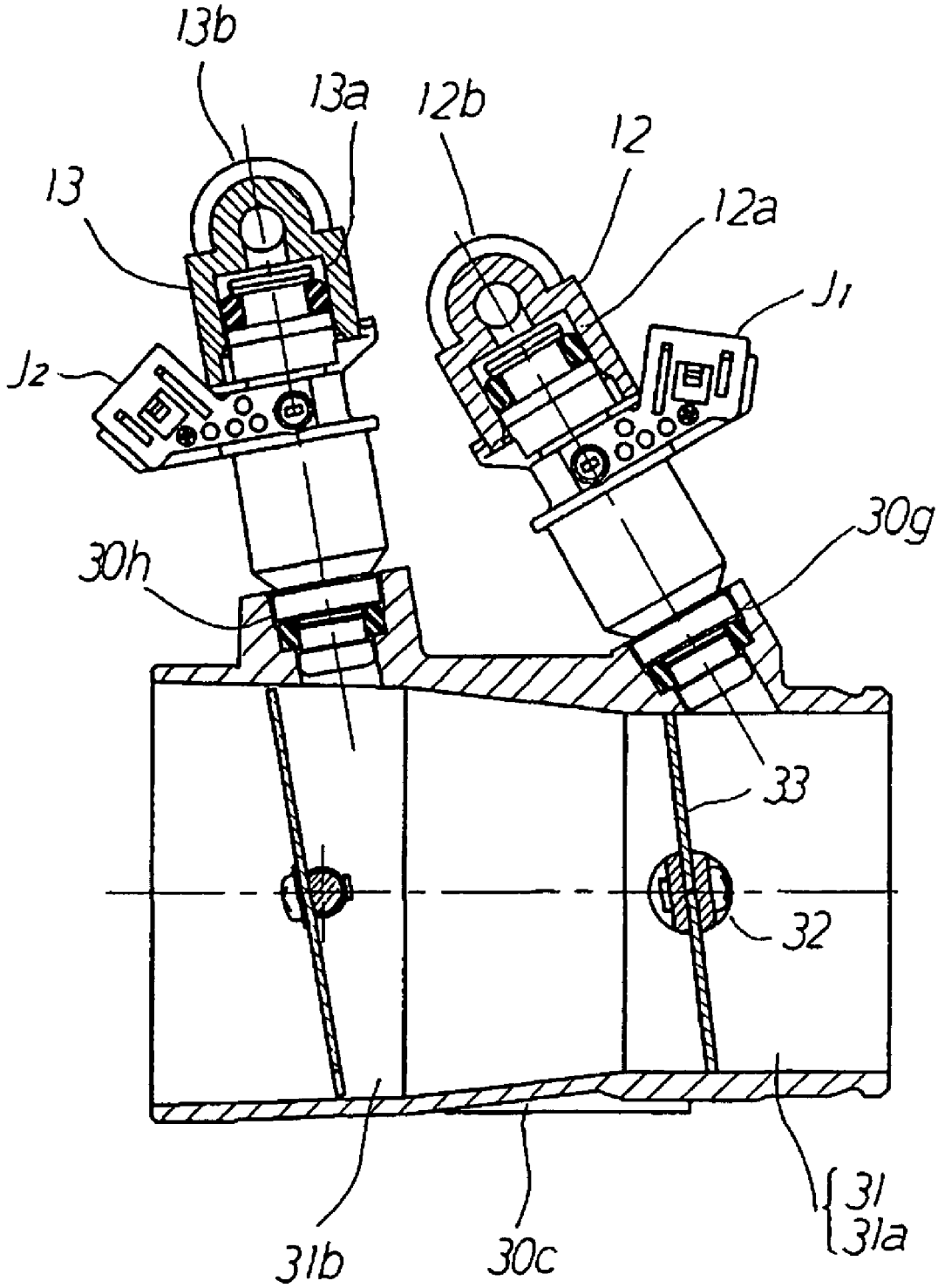
FIG. 5 is a longitudinal sectional view taken along the C—C line of FIG. 3.

First fuel injection valves J1, J1 are provided at two throttle bodies 30*c*, 30*d* on the right side in FIG. 3, and are held by first fuel injection valve inserting holes 12*a*, 12*a* and first inserting holes 30*g* (illustrated in FIG. 5), where the holes 12*a*, 12*a* are provided through at an another side first fuel distribution pipe 12 extended toward the side direction, and the holes 30*g* are provided at the throttle bodies 30*c*, 30*d*.

Further, an another side first inserting boss 12*b* is formed at a left end of the another side first fuel distribution pipe 12, and projected toward the one side direction X (in the left direction in FIG. 3). Further, an another side first inserting hole 12*c* is provided from an end portion 12*b*1 (a left end in FIG. 3) of the another side first inserting boss 12*b* toward the first fuel injection valve inserting hole 12*a*.

That is, the another side first inserting hole 12*c* is connected to the first fuel injection valve inserting hole 12*a*.

Further, second fuel injection valves J2, J2 are provided at the two throttle bodies 30*c*, 30*d* on the left side, and held by second fuel injection valve inserting holes 13*a* and second inserting holes 30*h* (illustrated in FIG. 5), where the holes 13*a* are provided at the common another side second fuel distribution pipe 13 extended toward the side direction, and the holes 30*h* are provided at the throttle bodies 30*c*, 30*d*.

Further, an another side second inserting boss 13*b* is formed at a left end of the another side second fuel distribution pipe 13, and projected toward the one side direction X (the left direction in FIG. 3) Further, an another side second inserting hole 13*c* is provided from an end portion 13*b*1 of the another side second inserting boss 13*b* toward each second fuel injection valve inserting hole 13*a*.

That is, the another side second inserting hole 13*c* is connected to each second fuel injection valve inserting hole 13*a*.

Further, the another side first inserting boss 12*b* provided with the another side first inserting hole 12*c* is provided in parallel to the another side second inserting boss 13*b* provided with the another side second inserting hole 13*c*. Openings of the another side first inserting hole 12*c* and the another side second inserting hole 13*c* are in parallel each other and opened toward the one side direction X (the left side direction in FIG. 3).

As described above, the following two openings are opened on an another side wall 30*g* of the one side throttle body 30*b*, which is provided slongside the another side throttle body 30*c*. Those are the opening of the one side first inserting hole 10*c* of the one side first fuel distribution pipe 10 toward the end portion 10*b*1 of the one side first inserting boss 10*b*, and the opening of the one side second inserting hole 11*c* of the one side second fuel distribution pipe 11 toward the end portion 11*b*1 of the one side inserting boss 11*b*. Further, the following two openings are opened on a one sidewall 30*x* of the another side throttle body 30*c*, which is provided alongside the one side throttle body 30*b*. Those are the opening of the another side first inserting hole 12*c* of the another side first fuel distribution pipe 12 toward the end portion 12*b*1 of the another second inserting boss 12*b*, and the opening of the another side second inserting hole 13*c* of the another side second fuel distribution pipe 13 toward the end portion 13*b*1 of the another side second inserting boss 13*b*.

Further, the opening of the one side first inserting hole 10*c* toward the end portion 10*b*1 and the opening of the another side first inserting hole 12*c* toward the end portion 12*b*1 are opened coaxially and opposingly. Further, the opening of the one side second inserting hole 11*c* toward the end portion

11b1 and the opening of the another side second inserting hole 13c toward the end portion 13b1 are opened coaxially and opposingly.

Further, the fuel supply pipe F is provided between the another side wall 30g of the one side throttle body 30b and the one side wall 30x of the another side throttle body 30c, where the throttle bodies 30b and 30c are provided side by side. Here, the first one side inserting pipe 1c is inserted and provided in the one side first inserting hole 10c of the one side first fuel distribution pipe 10, and the first another side inserting pipe 1d is inserted and provided in the another side first inserting hole 12c of the another side first fuel distribution pipe 12. Further, the second one side inserting pipe 2d is inserted and provided in the one side second inserting hole 11c of the one side second fuel distribution pipe 11, and the second another side inserting pipe 2c is inserted and provided in the another side second inserting hole 13c of the another side second fuel distribution pipe 13.

On the other hand, the one side throttle body 30b and the another side throttle body 30c, which are provided side by side, are fixed sideward by a stay or the like. Thereby, the first one side inserting pipe 1c and the first another side inserting pipe 1d are undetachably held by the one side first inserting hole 10c and the another side first inserting hole 12c.

On the other hand, the second one side inserting pipe 2d and the second another side inserting pipe 2c are undetachably held by the one side second inserting hole 11c and the another side second inserting hole 13c.

Accordingly, the fuel supply pipe F is provided between the throttle bodies 30b, 30c which are provided side by side, while being connected to the fuel distribution pipes 10, 11, 12, 13. Further, the fuel flow-in passage 1e of the fuel supply pipe F is connected to the pump discharge passage of the fuel pump which is not illustrated in the drawings.

Further, the fuel increased in pressure by the fuel pump is supplied to the fuel flow-in passage 1e of the fuel supply pipe F through the fuel pipe, and the fuel in the fuel flow-in passage 1e is supplied toward the first fuel injection valves J1, J1 mounted at the left side throttle bodies 30a, 30b, through the first one side fuel supply passage if, the one side first inserting hole 10c of the one side first fuel distribution pipe 10, and each of the first fuel injection valve inserting holes 10a, 10a.

Further, the fuel in the fuel flow-in passage 1e is supplied toward the first fuel injection valves J1, J1 mounted at the right side throttle bodies 30c, 30d, through the first another side fuel supply passage 1g, the another side first inserting hole 12c and each of the first fuel injection valve inserting holes 12a, 12a.

Furthermore, the fuel in the fuel flow-in passage 1e is supplied toward the second one side fuel supply passage 2d of the second fuel supply pipe 2 through the first connection pipe 3a, the connection pipe 3c and the second connection pipe 3b. The fuel is supplied into the one side second inserting hole 11c of the one side second fuel distribution pipe 11, and this fuel is supplied to the second fuel injection valves J2, J2 mounted at the left side throttle bodies 30a, 30b, through the second fuel injection valve inserting holes 11a.

On the other hand, the fuel in the second one side fuel supply passage 2d is supplied to the second another side fuel supply passage 2e, and the fuel in the second another side fuel supply passage 2e is supplied to the second fuel injection valves J2, J2 mounted at the right side throttle bodies 30c, 30d, through the another side second inserting holes 13c and the second fuel injection valve inserting hole 13a of the another side second fuel distribution pipe 13.

According to the structure of the fuel supply pipe in the multiple throttle body comprising two fuel injection valves according the present invention having the above-described constitution, the number of the fuel pipe for connecting the fuel pump and the fuel flow-in passage of the fuel supply pipe is one, so that appearance can be made compact when mounting it to the motorcycle, and designing freedom of piping the fuel pipe can be improved.

Further, the fuel supply pipe is provided between the another side wall and the one side wall of the throttle bodies provided side by side. Further, the fuel supply pipe is inserted and held between the one side first inserting hole and the opposing another side first inserting hole, and between the one side second inserting hole and the opposing another side second inserting hole. Thus, special mounting members and screws are not necessary. Further, increasing of the side length of the multiple throttle body is prevented, and the fuel supply pipe is protected by the throttle bodies without directly exposing to the outside and, further, the appearance can be also improved.

What is claimed is:

1. A structure of a fuel supply pipe in a multiple throttle body comprising two fuel injection valves, wherein the multiple throttle body has a plurality of throttle bodies arranged sideward, each of which has a first fuel injection valve and a second fuel injection valve, wherein the first fuel injection valve is provided toward an intake passage on the downstream side of a throttle valve for opening/closing the intake passage, and the second fuel injection valve is provided toward an intake passage on the upstream side of the throttle valve, wherein a fuel supply pipe is formed with a first fuel supply pipe, a second fuel supply pipe and a fuel connection pipe, wherein the first fuel supply pipe comprises a first one side inserting pipe, a first another side inserting pipe and a fuel flow-in pipe, wherein the first one side inserting pipe is projected toward one side direction from a first cylindrical portion, the first another side inserting pipe is projected toward another side direction from the first cylindrical portion and is formed coaxially with the first one side inserting pipe and a fuel flow-in pipe is projected toward another direction from the first cylindrical portion;

wherein a fuel flow-in passage is provided toward an end portion of the fuel flow-in pipe from an end portion of the first cylindrical portion, and the fuel flow-in passage is provided with a first one side fuel supply passage and a first another side fuel supply passage, where the first fuel supply passage is provided toward an end portion of the first one side inserting pipe, and the first another side fuel supply passage is provided toward an end portion of the first another side inserting pipe, wherein the second fuel supply pipe comprises a second one side inserting pipe and a second another side inserting pipe, where the second one side inserting pipe is projected toward the one side direction in parallel to the first one side inserting pipe from a second cylindrical portion; and the second another side inserting pipe is projected toward the another side direction from the second cylindrical portion and is formed coaxially with the second one side inserting pipe, wherein, a second one side fuel supply passage is provided toward an end portion of the second one side inserting pipe from an end portion of the second cylindrical portion; and a second another side fuel supply passage is provided toward an end portion of the second another side inserting pipe from the second one side fuel supply passage, wherein the fuel connection pipe is for connecting the fuel flow-in passage and the second one side fuel supply passage, where the fuel flow-in passage is opened on the end portion of the first cylindrical portion of the first fuel supply pipe; and the second one side fuel supply passage is opened on the end portion of the second cylindrical portion of the second fuel supply pipe, wherein a one side first inserting boss is projected and formed toward the another side direction at a one side first fuel distribution pipe which is for holding the first fuel injection valve with a throttle body on one side, throttle bodies being provided side by side, wherein a one side first inserting hole is provided at the one side first inserting boss, where one end of the one side first inserting hole is connected to a first fuel injection valve inserting hole, and another end is opened in the another side direction toward an end portion of the one side first inserting boss, wherein a one side second inserting boss is formed at a one side second fuel distribution pipe, which is for holding the second fuel injection valve with the one side throttle body, where the one side second inserting boss is projected in the another side direction and formed in parallel to the one side first inserting boss, wherein a one side second inserting hole is provided at the one side second inserting boss, where one end of the one side second inserting hole is connected to a second fuel injection valve inserting hole and another end is opened in the another side direction toward an end portion of the one side second inserting boss, wherein an another side first inserting boss is protected and formed toward the one side direction at an another side first fuel distribution pipe, which is for holding the first fuel injection valve with the throttle body on another side, the throttle bodies being provided side by side, wherein an another side first inserting hole is provided at the another side first inserting boss, where one end of the another side first inserting hole is connected to the first fuel injection valve inserting hole, and another end is opened in the one side direction toward an end portion of the another side first inserting boss, wherein an another side second inserting boss is formed at an another side second fuel distribution pipe, which is for holding a second fuel injection valve with the another side throttle body, where the another side second inserting boss is projected toward the one side direction and formed in parallel to the another side first inserting boss, wherein an another side second inserting hole is provided at the another side second inserting boss, where one end of the another side second inserting hole is connected to a second fuel injection valve inserting hole, and another end is opened in the one side direction toward an end portion of the another side second inserting boss, wherein the fuel supply pipe is provided between the another side wall side of the one side throttle body and the one side wall side of the another side throttle body, wherein the first one side inserting pipe is inserted into the one side first inserting hole; the second one side inserting pipe is inserted into the one side second inserting hole; the first another side inserting pipe is inserted into the another side first inserting hole, and the second another side inserting pipe is inserted into the another side second inserting hole, and wherein the inserting pipes of the fuel supply pipe are held by the inserting holes of the fuel distribution pipes respectively.

* * * * *